US012534279B2

(12) United States Patent
Tuber et al.

(10) Patent No.: US 12,534,279 B2
(45) Date of Patent: Jan. 27, 2026

(54) HANG TAG FOR SUSPENDING A WRENCH FOR DISPLAY

(71) Applicant: Apex Brands, Inc., Apex, NC (US)

(72) Inventors: Jonathan Tuber, Apex, NC (US); Ken Peter, Apex, NC (US)

(73) Assignee: Apex Brands, Inc., Apex, NC (US)

( * ) Notice: Subject to any disclaimer, the term of this patent is extended or adjusted under 35 U.S.C. 154(b) by 22 days.

(21) Appl. No.: 18/603,635

(22) Filed: Mar. 13, 2024

(65) Prior Publication Data

US 2025/0289637 A1 Sep. 18, 2025

(51) Int. Cl.
*B65D 73/00* (2006.01)
*A45C 11/26* (2006.01)

(52) U.S. Cl.
CPC ..... *B65D 73/0064* (2013.01)

(58) Field of Classification Search
CPC ..... B65D 73/0021; B65D 73/0064
USPC ..... 206/349, 379, 806; 211/70.6
See application file for complete search history.

(56) References Cited

U.S. PATENT DOCUMENTS 4,019,632 A * 4/1977 Greenlee ..... B65D 73/0064 206/349
5,713,467 A * 2/1998 Kao ..... B65D 73/0014 206/349
5,803,253 A * 9/1998 Zakarian ..... B65D 73/0064 206/349
6,241,208 B1 * 6/2001 Lin ..... B65D 73/0014 206/349
6,935,516 B2 * 8/2005 Chiang ..... B65D 73/0064 206/349
8,960,453 B2 * 2/2015 Chang ..... B65D 73/0014 206/349
2005/0061757 A1 * 3/2005 Chiang ..... B65D 73/0064 211/70.6
2012/0091074 A1 * 4/2012 Chang ..... B65D 73/0014 211/4

* cited by examiner

*Primary Examiner* — Luan K Bui
(74) *Attorney, Agent, or Firm* — Burr & Forman

(57) ABSTRACT

A hang tag for display of an adjustable wrench having a fixed jaw and a movable jaw may include a base member, and a folding member that folds to engage with the base member to retain the adjustable wrench in the hang tag. The base member may include a hanging portion that includes a hanging aperture through which a hook or other protrusion is insertable to suspend the hang tag, and a retaining portion that also includes the folding member and that retains the adjustable wrench responsive to the folding member contacting the base member to enclose a neck of the adjustable wrench via a locking assembly. An operating window may be formed at the retaining portion of the base member to enable access to a worm gear on opposite sides of the adjustable wrench.

18 Claims, 11 Drawing Sheets

HANG TAG FOR SUSPENDING A WRENCH FOR DISPLAY

TECHNICAL FIELD

Example embodiments generally relate to hand tools and, in particular, relate to a hang tag that displays a wrench while enabling a customer to test operation of the wrench.

BACKGROUND

Hand tools are commonly used across all aspects of industry and in the homes of consumers. Hand tools are employed for multiple applications including, for example, tightening, component joining, and/or the like. For some applications, an adjustable wrench (or adjustable spanner) with one movable and one fixed jaw may be preferred. These familiar hand tools typically place the moveable jaw at a distal end of the wrench and allow the span of the wrench (i.e., the space between the fixed jaw and the movable jaw) to be adjusted by moving the movable jaw farther away from the fixed jaw or closer to the fixed jaw. Each of the fixed jaw and the movable jaw typically have a flat engaging surface and the engaging surfaces lie in substantially parallel planes.

Adjustment of the span between jaws is commonly accomplished via an attachment of the movable jaw to a toothed rack portion. The toothed rack portion is movably retained in a slot and a worm gear (or adjusting screw) is retained in an opening adjacent to the toothed rack portion. Turning of the worm gear causes engagement with the rack portion that correspondingly carries the toothed rack portion (and therefore also the movable jaw) in a direction determined by the direction the worm gear is rotated.

This arrangement works quite well for enabling the adjustable wrench to get a grip on nuts, screw heads or other fasteners that have hex shaped heads or at least heads with parallel opposing sides. Customers considering the purchase of a new adjustable wrench typically prefer to be allowed to test the adjustment experience. However, when these adjustable wrenches are packaged for display, the packaging typically interferes with access to the worm gear, and therefor also the ability to test the adjustment experience. Moreover, the packaging itself can often be difficult for the customer to remove after purchase. Thus, there is need to balance the security and interactivity of a display means for displaying an adjustable wrench.

BRIEF SUMMARY OF SOME EXAMPLES

In an example embodiment, a hang tag for display of an adjustable wrench having a fixed jaw and a movable jaw, may be provided. The movable jaw may be operable via turning a worm gear exposed on opposite sides of the adjustable wrench. The hang tag may include a base member, and a folding member that folds to engage with the base member to retain the adjustable wrench in the hang tag. The base member may include a hanging portion that includes a hanging aperture through which a hook or other protrusion is insertable to suspend the hang tag, and a retaining portion that also includes the folding member and that retains the adjustable wrench responsive to the folding member contacting the base member to enclose a neck of the adjustable wrench via a locking assembly. An operating window may be formed at the retaining portion of the base member to enable access to the worm gear on both of the opposite sides of the adjustable wrench.

In another example embodiment, a method of packaging an adjustable wrench for display may be provided. The method may include molding a hang tag including a base member, and a folding member, where the base member includes a hanging portion that includes a hanging aperture through which a hook or other protrusion is insertable to suspend the hang tag, and a retaining portion that also includes an operating window. The method further includes inserting the adjustable wrench in the retaining portion, folding the folding member to contact the base member to enclose a neck of the adjustable wrench, and engaging a locking assembly to retain the adjustable wrench in the hang tag such that a worm gear of the adjustable wrench is accessible on at least one side via the operating window.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
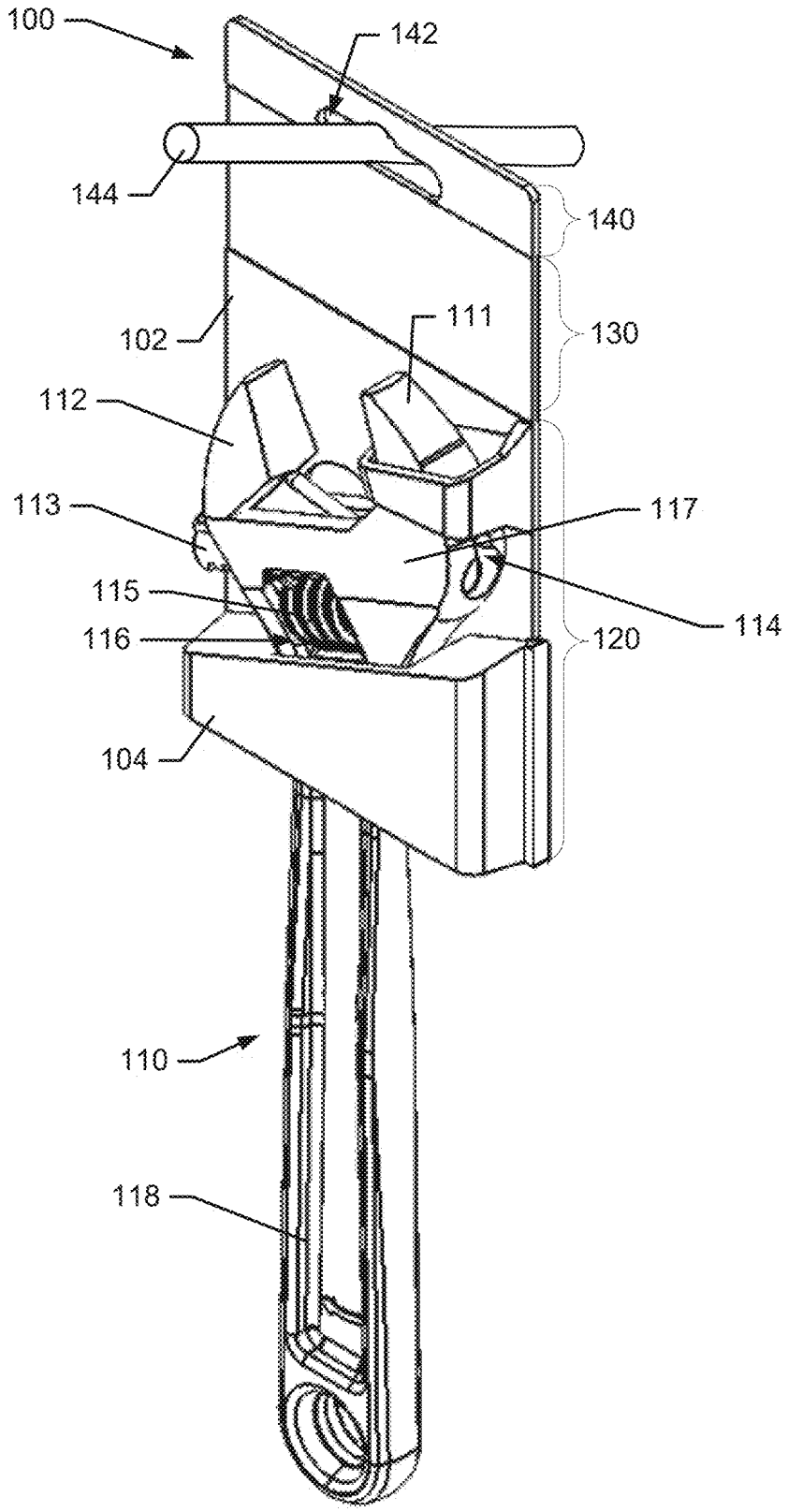
FIG. 1 illustrates a front perspective view of an adjustable wrench hanging from a hook via a hang tag according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a device for displaying a hand tool such as an adjustable wrench. The device, which may be referred to as a hang tag, has an improved design that enables the adjustable wrench to be tested with respect to its adjustable operations while it remains in the hang tag, and even potentially also while suspended via the hang tag. The hang tag is structured to be molded from a single piece of material (e.g., plastic) so that cost and complexity remain low. However, the specific design attributes described herein enable secure holding of the adjustable wrench by the hang tag until purchase, after which time the hang tag can be relatively easily removed.

Figure 2:
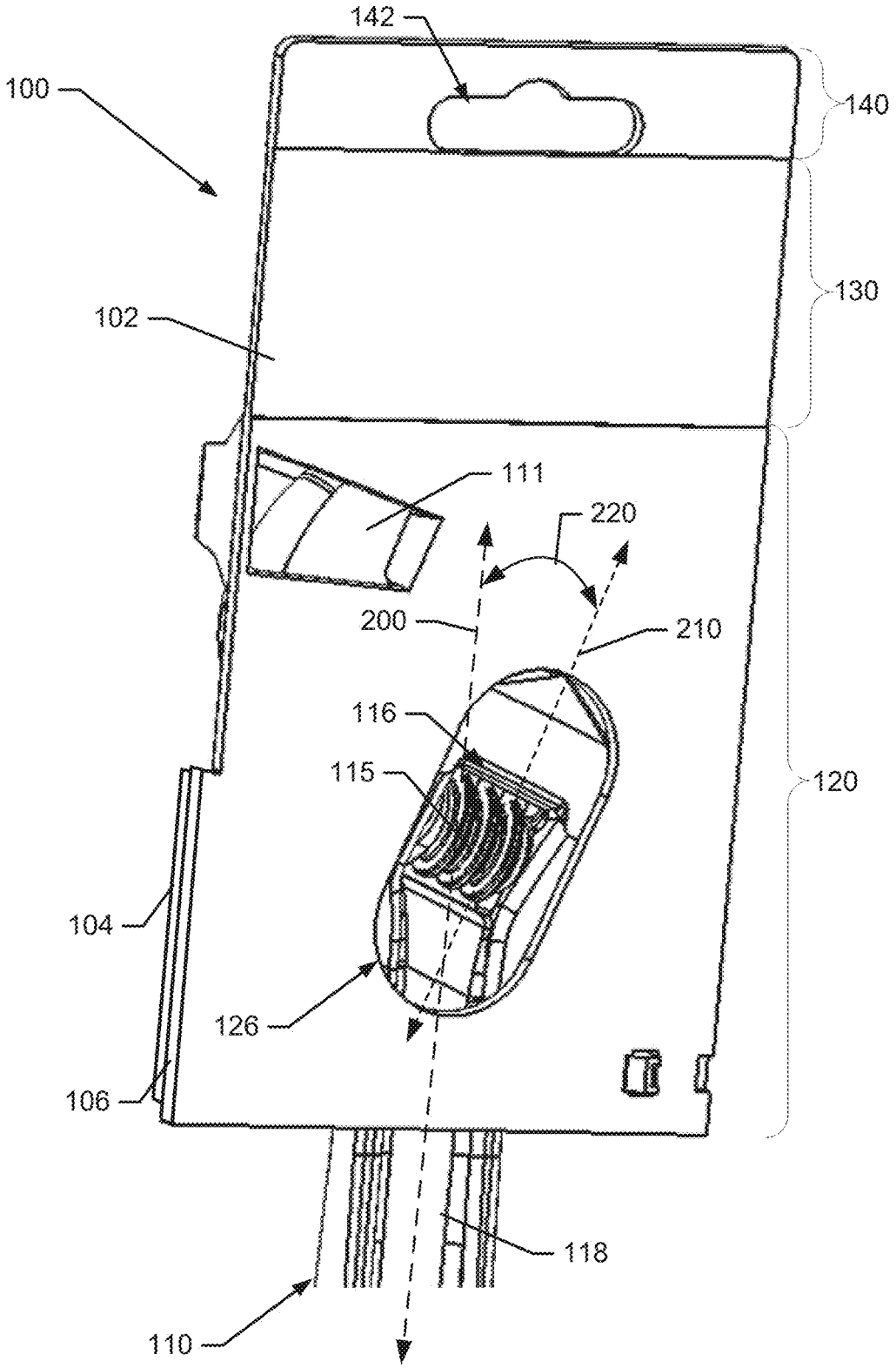
FIG. 2 is another perspective view of the hang tag of FIG. 1 in accordance with an example embodiment.
Figure 3:
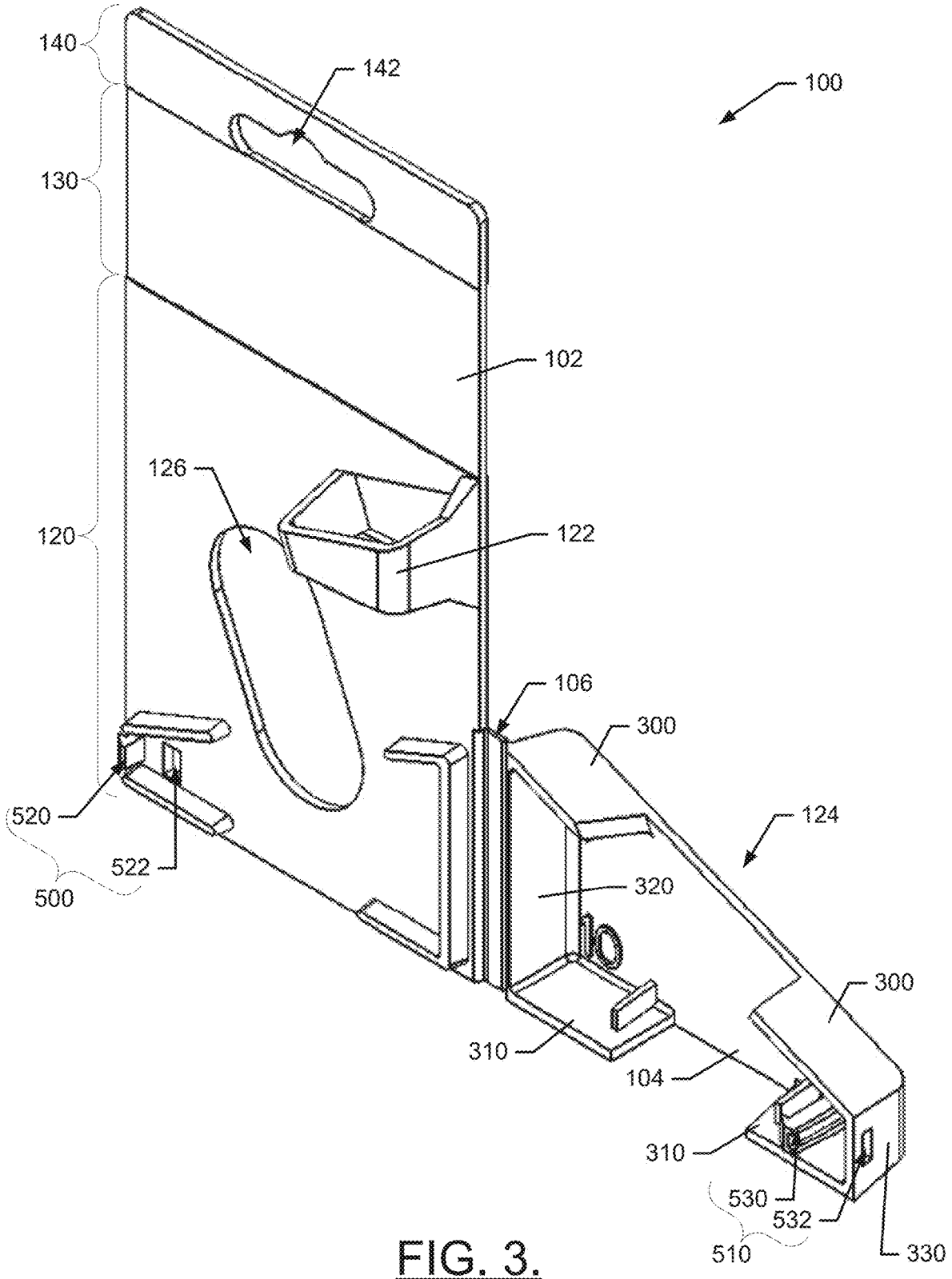
FIG. 3 is a front perspective view of the hang tag in an open state in accordance with an example embodiment.
Figure 4:
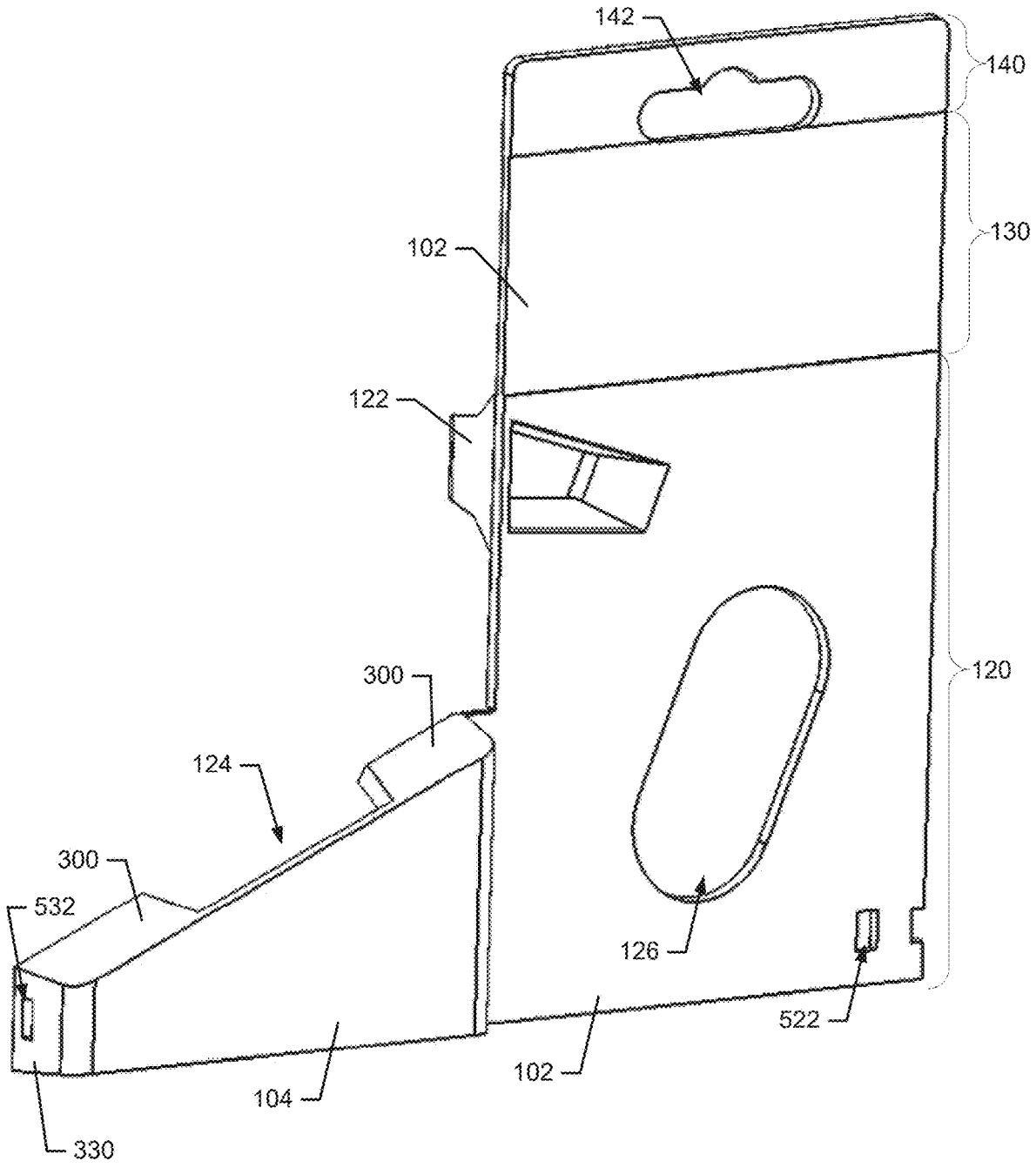
FIG. 4 is a rear perspective view of the hang tag in the open state in accordance with an example embodiment.
Figure 5:
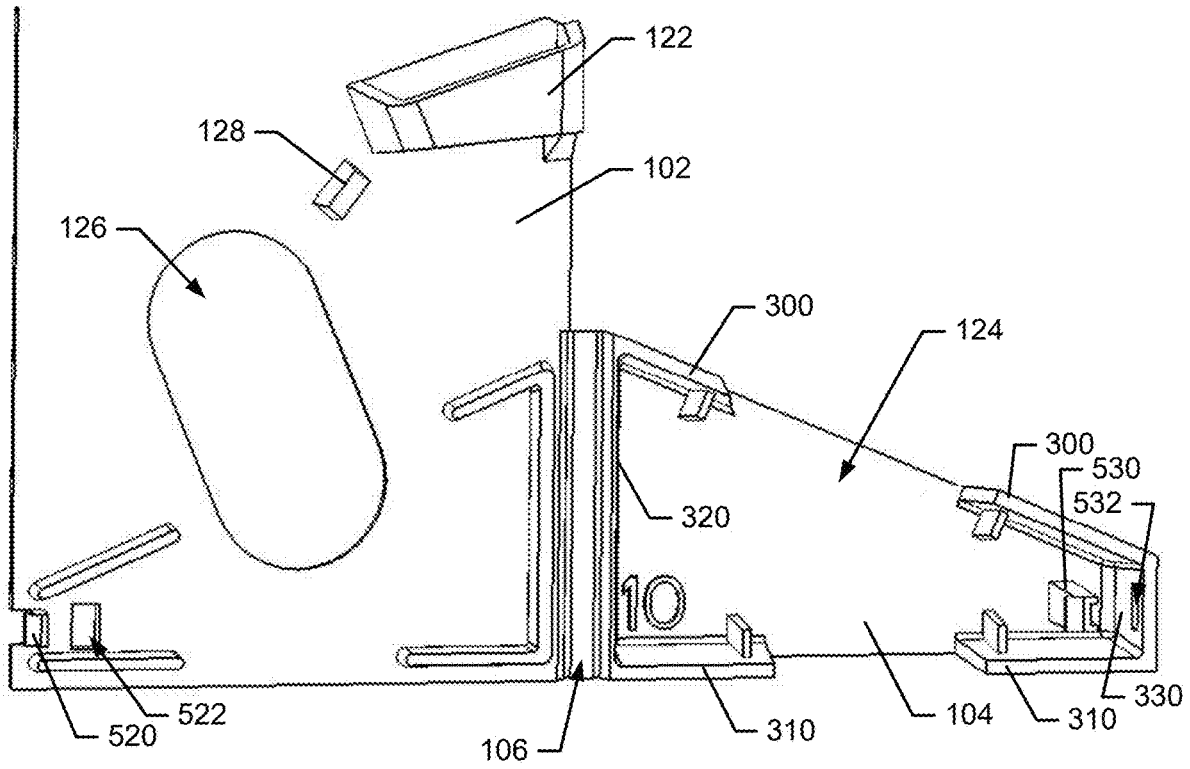
FIG. 5 is a front view of the retainer portion of the hang tag in accordance with an example embodiment.
Figure 6:
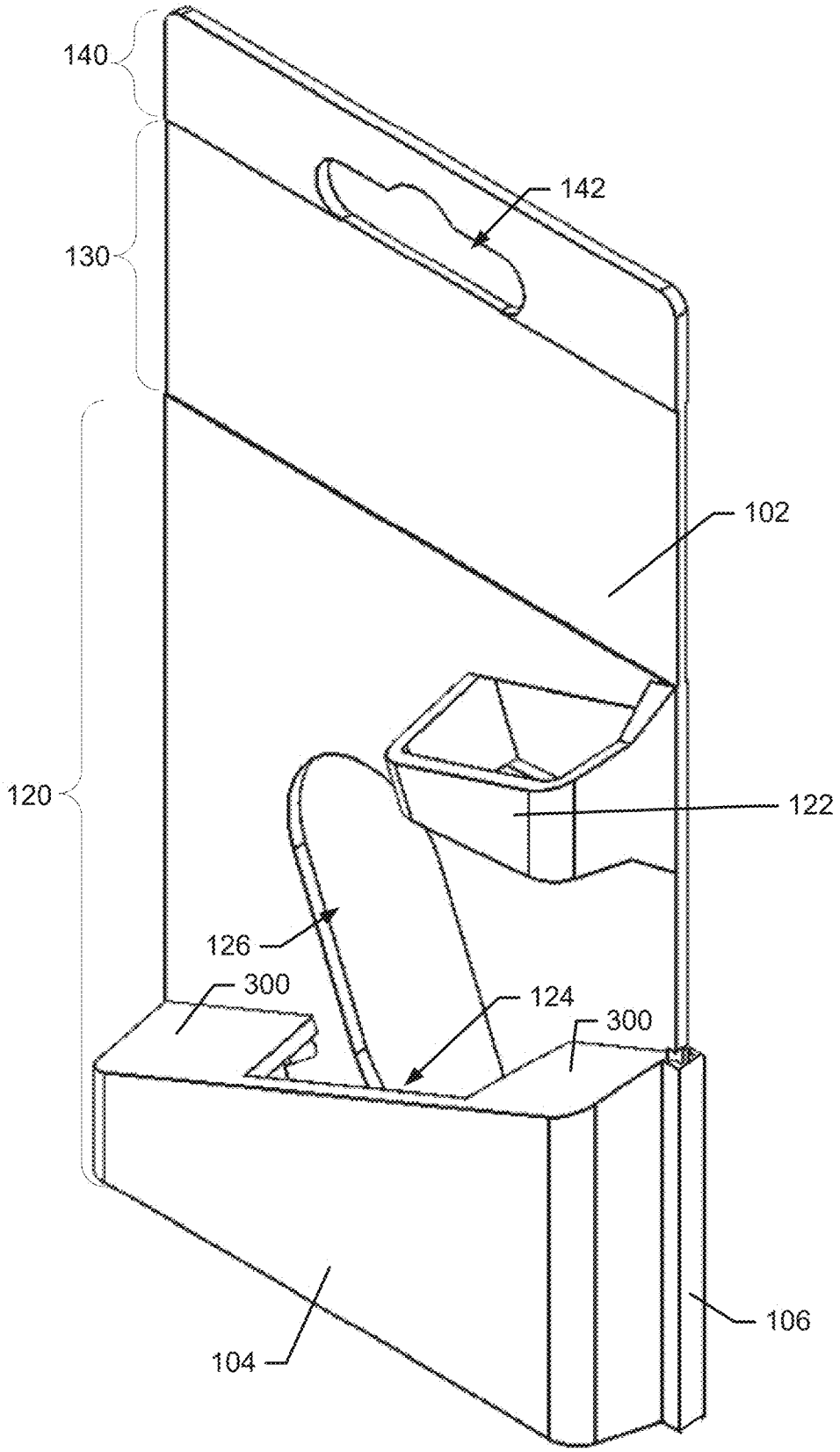
FIG. 6 is a front perspective view of the hang tag in a closed state in accordance with an example embodiment.
Figure 7:
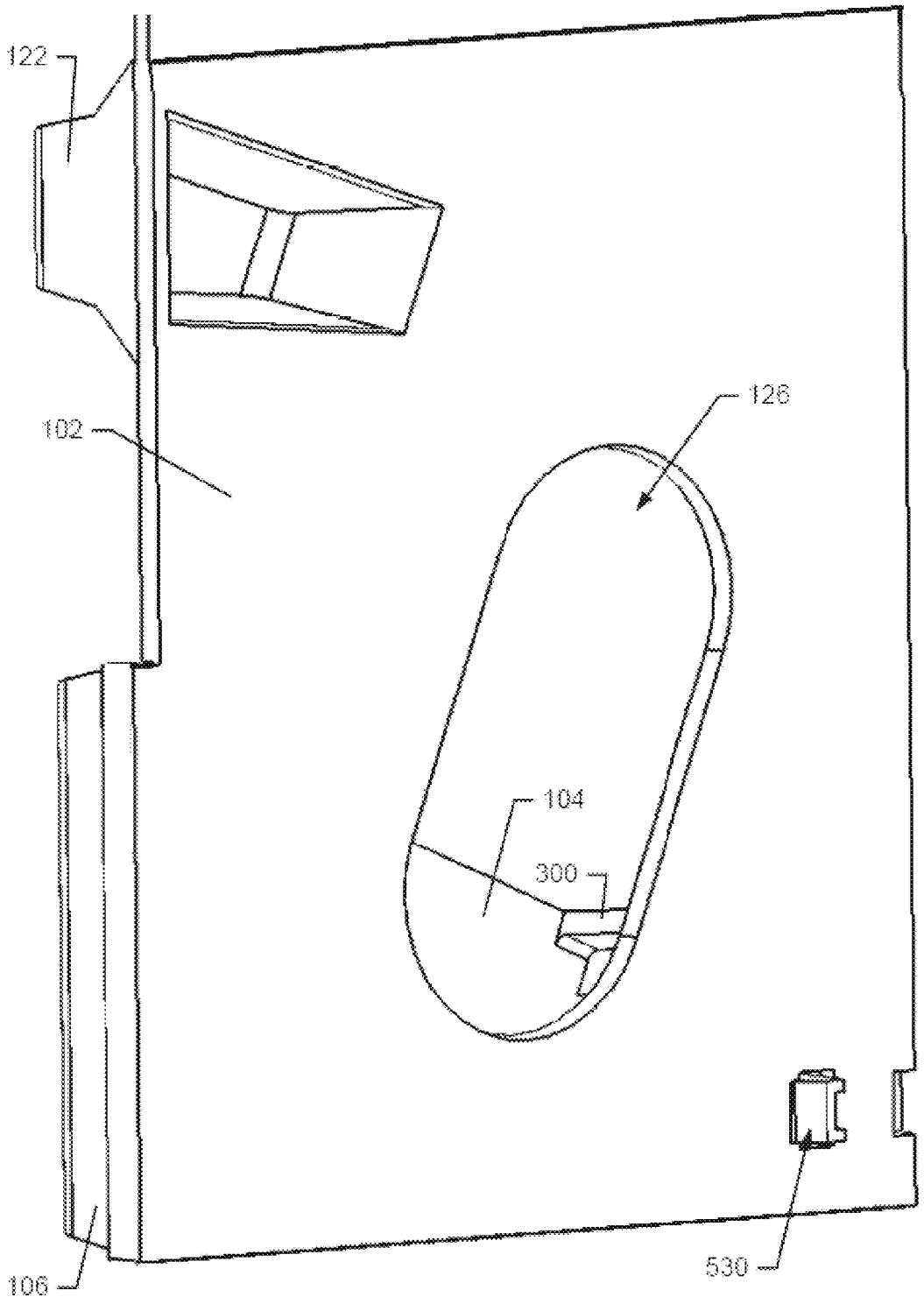
FIG. 7 is a rear perspective view of the hang tag in the closed state according to an example embodiment.
Figure 8:
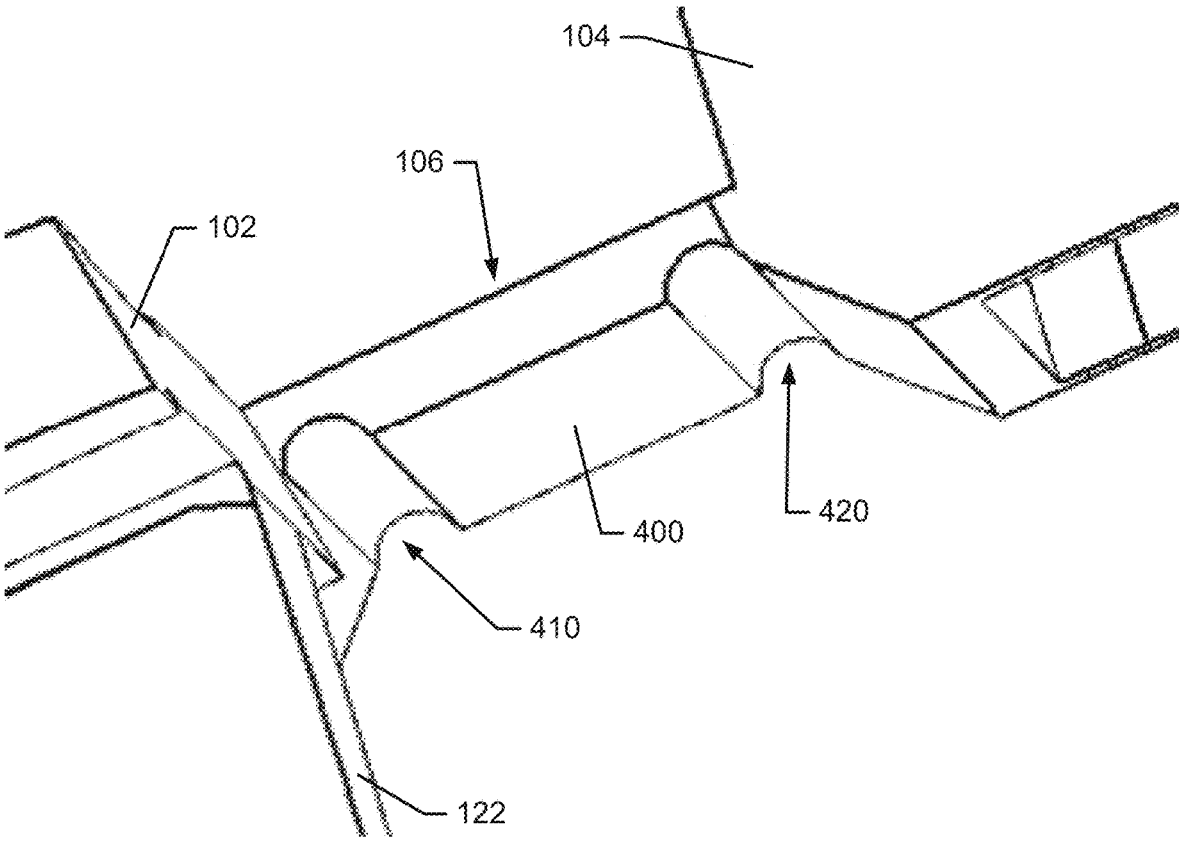
FIG. 8 illustrates a top perspective view of a bridge member according to an example embodiment.
Figure 9:
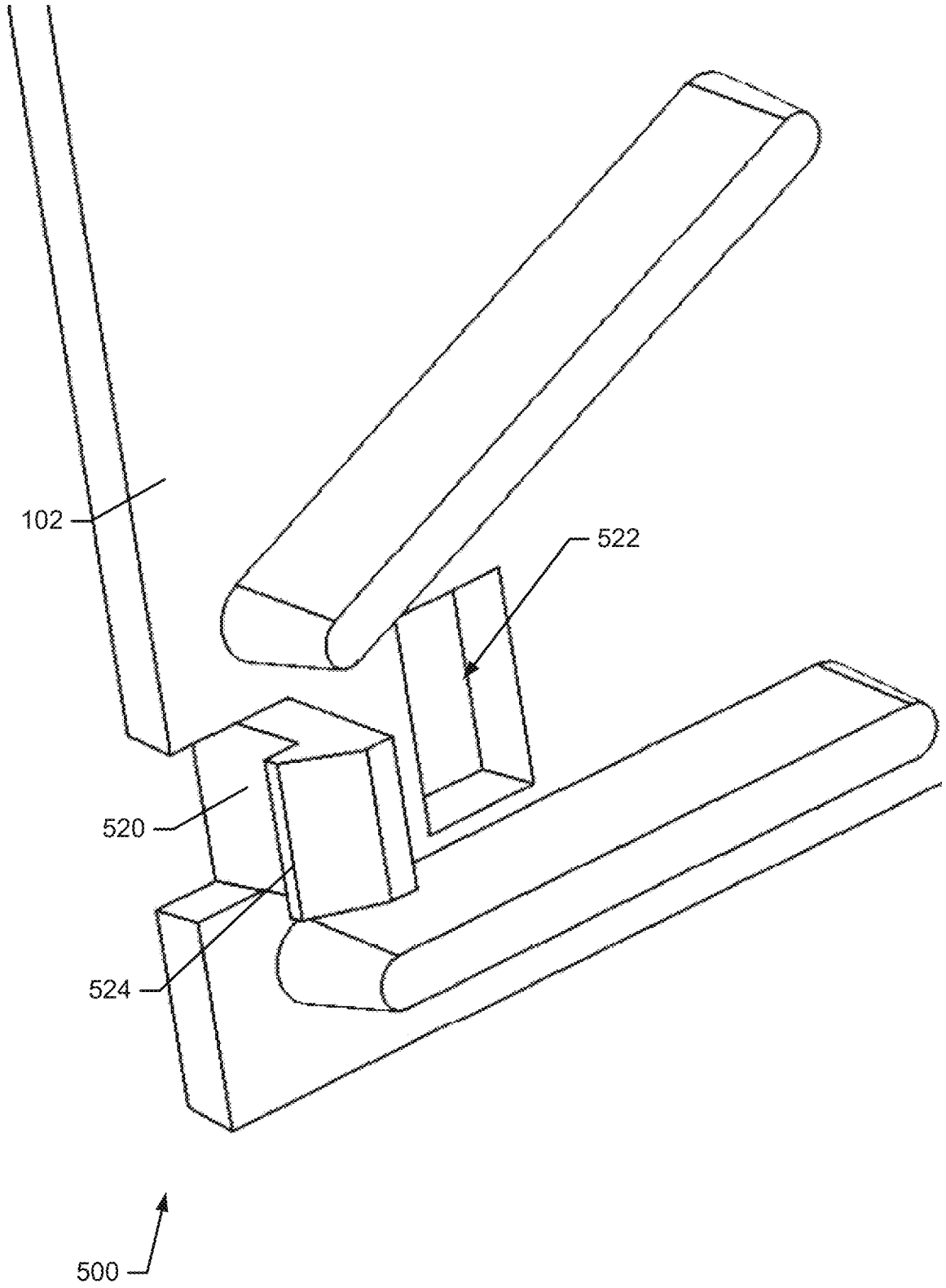
FIG. 9 illustrates a perspective view of a first locking portion according to an example embodiment.
Figure 10:
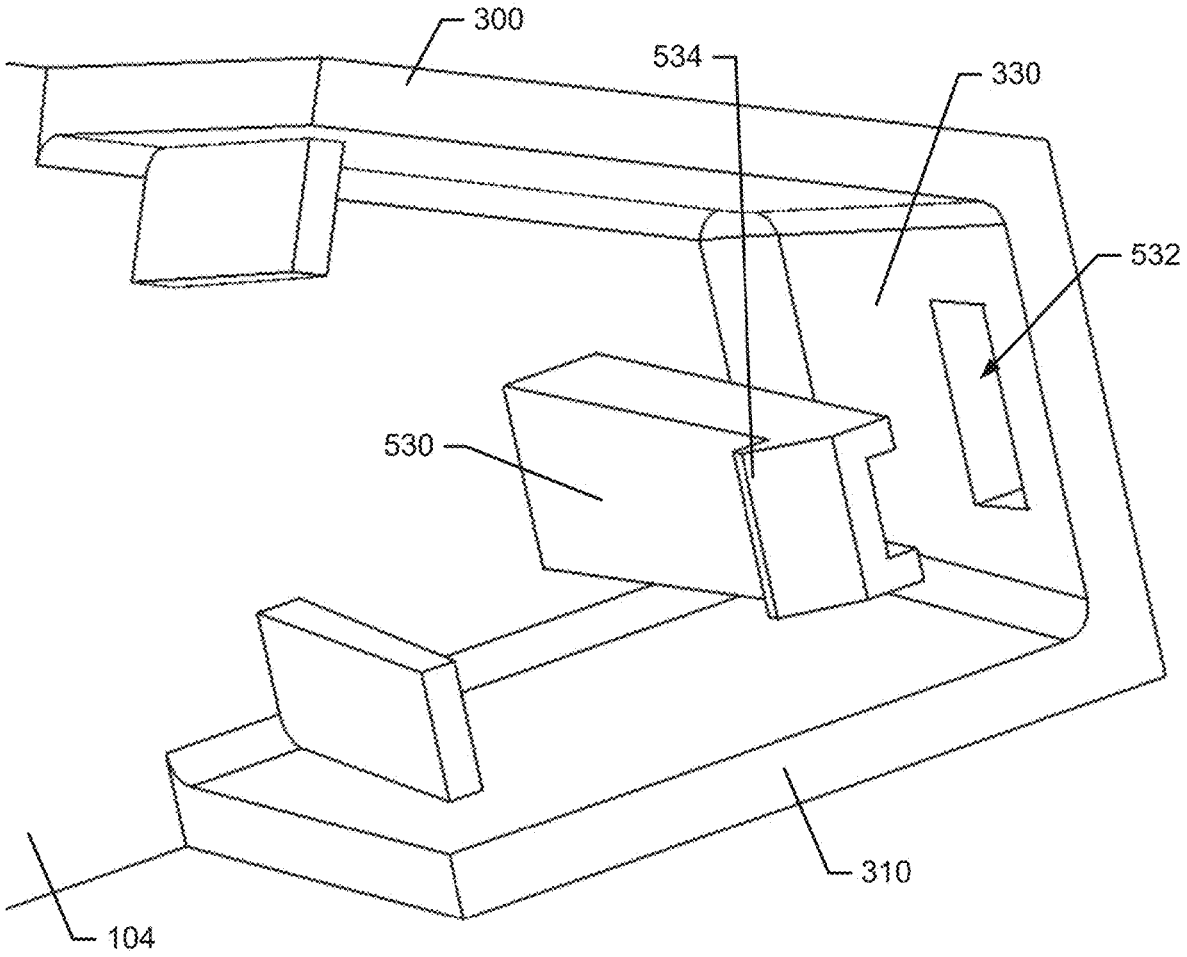
FIG. 10 illustrates a perspective view of a second locking portion according to an example embodiment.

FIGS. 1 and 2 show front and back perspective views of a hang tag 100 of an example embodiment while suspending an adjustable wrench 110. FIGS. 3-5 show front and back perspective views of portions of the hang tag 100 in an open state and without the adjustable wrench 110. FIGS. 6 and 7 show front and back perspective views of portions of the hang tag 100 in a closed state and without the adjustable wrench 110. FIG. 8 shows details of a bridge member according to an example embodiment, and FIGS. 9 and 10 illustrate close-up perspective views of complementary portions of a locking assembly of an example embodiment.

Referring first to FIGS. 1 and 2, it can be seen that the hang tag 100 includes a base member 102 and a folding member 104 that are molded together as one molded assembly, and connected to each other via a bridge member 106. The base member 102 may be a substantially flat or plate-like structure that lies mostly in a single plane. However, some portions of the plate-like structure of the base member 102 may be removed and other structures may be added at other portions to extend out of the single plane as discussed below. The folding member 104 is folded over to engage with the base member 102 as described in greater detail below in order to hold and retain the adjustable wrench 110 for display.

The hang tag 100 may generally include a retaining portion 120, a label portion 130, and a hanging portion 140, all of which play a role in displaying of the adjustable wrench 110 in the hang tag 100. The hanging portion 140 may be disposed opposite the retaining portion 120 with respect to the label portion 130. Moreover, in a typical situation, the hanging portion 140 may be disposed on top with the label portion 130 immediately below and visible to the customer to include marketing material, descriptions of the adjustable wrench, branding information, and/or the like. The retaining portion 120 may then be on the bottom, and may actually retain and hold the adjustable wrench 110. The base member 102 may extend through and form a part of each of the retaining portion 120, the label portion 130, and the hanging portion 140. However, the folding member 104, and the bridge member 106 may each only be parts of the retaining portion 120.

The adjustable wrench 110 includes a jaw assembly that further includes fixed jaw 111 and a movable jaw 112. The movable jaw 112 is attached to a rack portion 113 that slides in a slot 114. The rack portion 113 interfaces with a worm gear 115 to carry the movable jaw 112 (via interface with teeth in the rack portion 113) responsive to a finger (usually a thumb) of an operator spinning or rotating the worm gear 115 in either direction. The worm gear 115 is accessible due to being disposed in an opening 116 formed in a body portion 117 of the adjustable wrench 110. The jaw assembly and body portion 117 (from which the fixed and movable jaws 111 and 112 extend) are connected to a handle 118 via a neck portion that is grasped by the retaining portion 120 of the hang tag 100 as described below.

The hanging portion 140 may simply be a flat, plate-like portion of the top end of the base member 102. The hanging portion 140 may include a hanging aperture 142 through which a hook 144 or other protruding member may be inserted to hang the hang tag 100 from the hook 144. The label portion 130 may also simply be a flat, plate-like portion of the base member 102 located between the hanging portion 140 and the retaining portion 120. In some cases, a surface finish of the label portion 130 may be different to distinguish it from the hanging portion 140 and the retaining portion 120 as a guide for the affixing of labels. However, a different thickness or protrusions or grooves may alternatively be used to define boundaries of the label portion 130 to facilitate attachment of labels in some cases. Alternatively, no distinction could be made between the hanging portion 140 and the retaining portion 120, or the label portion 130 could be completely eliminated.

The hanging portion 140 and the label portion 130 are entirely formed from the base member 102. However, the retaining portion 120 is formed from part of the base member 102 and the entirety of the folding member 104 and bridge member 106. The retaining portion 120 includes a fixed jaw retainer 122 and a neck retainer 124 and an operating window 126. The fixed jaw retainer 122 may be a three sided rectangular pocket that is extended away from the plane in which a majority of the base member 102 lies to provide a space to receive the fixed jaw 111. Two of the three sides extend perpendicularly away from the base member 102 (and parallel to each other), and the third side extends between distal ends of these two perpendicular sides and parallel to the plane in which a majority of the base member 102 lies.

Although not required, the fixed jaw retainer 122 may be accompanied by a movement limiter 128, which may protrude perpendicularly away from the base member 102 proximate to the fixed jaw retainer 122 to limit movement of the body portion 117 of the adjustable wrench 110 in a direction toward the hanging aperture 142. The movement limiter 128 may help position the adjustable wrench 110 relative to the retaining portion 120 so that when the folding member 104 is folded over and locked into contact with the base member 102, the worm gear 115 of the adjustable wrench 110 is positioned to be accessible through the operating window 126.

The operating window 126 is a cutout portion formed in the base member 102 that, as noted above, grants manual access to the worm gear 115. In this regard, although an operator could certainly actuate the worm gear 115 with only one finger (e.g., the thumb) from one side (e.g., a front side) of the adjustable wrench 110, operators often prefer to actuate the worm gear 115 using two fingers (e.g., the thumb and index finger), which requires one finger on the front side of the adjustable wrench 110 and one finger on the back side of the adjustable wrench 110. By providing the operating window 126, the hang tag 100 enables the operator to utilize the preferred actuation method (two fingers) without removing the hang tag 100 from the adjustable wrench 110 and, in fact, while the hang tag 100 still hangs from the hook 144. This provides a significant advantage for access and usability while a customer evaluates the product, and may enhance the attractiveness of the product.

Further enhancing the access to the worm gear 115, the operating window 126 may be defined such that it is elongated in a direction that matches offset angle of the fixed and movable jaws 111 and 112. In this regard, as shown in FIG. 2, a longitudinal axis 200 of the adjustable wrench 110 may be separated from a tangent line 210 perpendicular to a rotational axis of the worm gear 115 by an offset angle 220. The tangent line 210 may also extend parallel to the engagement faces of each of the fixed and movable jaws 111 and 112, and may bisect the operating window 126. Moreover, the operating window 126 may be elongated along the tangent line 210 as shown in FIG. 2 to increase accessibility to and operability of the worm gear 115.

The neck retainer 124 may be shaped and formed to hold the adjustable wrench 110 in the hang tag 100 such that the longitudinal axis 200 of the adjustable wrench 110 is substantially parallel to lateral edges of the base member 102 (and therefore also substantially perpendicular to top and bottom edges of the base member 102). Based on the angling of the fixed and movable jaws 111 and 112, and the shape of the body portion 117 to support this angling, the neck retainer 124 may be formed by providing a top wall 300 at an angle that is approximately equal to the offset angle 220 relative to a bottom wall 310 that extends along the bottom edge of the hang tag 100. The neck retainer 124 may also include a gap formed in the top wall 300 and the bottom wall 310 on the folding member 104 to receive the neck of the adjustable wrench 110 therein (as shown in FIG. 1).

In addition to the neck retainer 124, which may be formed on the folding member 104, the folding member 104 may also include a first sidewall 320 and a second sidewall 330, which may be substantially parallel to each other and spaced apart from each other by the top and bottom walls 300 and 310. Each of the top and bottom walls 300 and 310, and the first and second sidewalls 320 and 330 may extend substantially perpendicularly away from the plane in which a majority of the base member 102 lies when the folding member 104 is in the closed state of FIGS. 1, 2, 6 and 7. Meanwhile, when molded, and when in the open state, the top and bottom walls 300 and 310, and the first and second sidewalls 320 and 330 may extend out of the plane in which a majority of the base member 102 lies in the opposite direction (as shown in FIG. 3). Thus, for example, the base member 102 and the folding member 104 may be molded together side-by-side, with the bridge member 106 providing the connection therebetween.

The bridge member 106 is shown in detail in FIG. 8 and may be formed of a bridging base 400, which may lie in a plane parallel to the plane in which a majority of the base member 102 lies (or in the same plane) when molded. In order to permit pivoting (or folding) of the folding member 104 to the closed state, a first groove 410 and a second groove 420 may be formed at opposite lateral sides of the bridging base 400. The first and second grooves 420 remove some material from the bridging base 400 to allow seamless folding of the folding member 104 to the closed state without pinching, bending or damaging portions of the bridging base 400. Notably, however, some example embodiments may remove the bridge member 106 entirely, and may replace the bridge member 106 with a snap fitting that operably couples the folding member 104 to the base member 102. In such examples, no bridge may be necessary, and the locking assembly discussed herein could be used with or without additional snap fitting components to lock the folding member 104 (structured as otherwise shown herein or similar) to the base member 102 (structured as otherwise shown herein or similar). Moreover, the bridge member 106 could itself be snap fit to either or both of the folding member 104 and the base member 102.

In the context of the example embodiment depicted herein, when the folding member 104 is folded over to the closed state with the adjustable wrench 110 disposed in the neck retainer 124, the folding member 104 may be affixed to the base member 102 via a locking assembly. The locking assembly is designed to be secure enough to hold the weight of the adjustable wrench 110 with the hang tag 100 suspended by the hook 144 and hanging aperture 142 and also prevent any inadvertent transition of the hang tag 100 out of the closed state. However, after purchase, a determined twist of the adjustable wrench 110 may provide sufficient force to cause the locking assembly to release and therefore cause the hang tag 100 to release the adjustable wrench 110 for use.

In an example embodiment, the locking assembly may include a first locking portion 500 disposed at the base member 102 and a second locking portion 510 disposed at the folding member 104. The first and second locking portions 500 and 510 may each include respective male and female portions that interface with each other to hold the base member 102 and the folding member 104 proximate to each other in the closed state. In this regard, the first locking portion 500 may include a first locking protrusion 520 formed proximate to a bottom corner of the base member 102 that is opposite bridge member 106 and farthest away from the hanging portion 140. The first locking portion 500 may also include a first locking aperture 522 formed in the base member 102 spaced apart from the first locking portion 500 in a direction toward the bridge member 106. Meanwhile, the second locking portion 510 may include a second locking protrusion 530 formed proximate to a bottom corner of the folding member 104 that is opposite bridge member 106 and farthest away from the hanging portion 140. The second locking portion 510 may also include a second locking aperture 532 formed in the second sidewall 330 of the folding member 104 spaced apart from the second locking portion 510 in a direction toward the bridge member 106.

The spacing between the first locking protrusion 520 and the first locking aperture 522 may be equal to the spacing between the second locking protrusion 530 and the second locking aperture 532 so that the first locking protrusion 520 engages the second locking aperture 532 and the second locking protrusion 530 engages the first locking aperture 522 approximately simultaneously upon transitioning the hang tag 100 to the closed state of FIGS. 1, 2, 6 and 7. As shown in FIGS. 9 and 10, respectively, the first locking protrusion 520 may have a first cantilevered extension 524 disposed at a distal end thereof, and the second locking protrusion 530 may have a second cantilevered extension 534 disposed at a distal end thereof. The first cantilevered extension 524 may extend away from the first locking protrusion 520 in a direction opposite the first locking aperture 522. When the first cantilevered extension 524 is passed through the second locking aperture 532, the first cantilevered extension 524 may engage with and grasp the second sidewall 330 to hold the first locking protrusion 520 in the second locking aperture 532. Similarly, the second cantilevered extension 534 may extend away from the second locking protrusion 530 in a direction opposite the second locking aperture 532. When the second cantilevered extension 534 is passed through the first locking aperture 522, the second cantilevered extension 534 may engage with and grasp the base member 102 to hold the second locking protrusion 530 in the first locking aperture 522.

Figure 11:
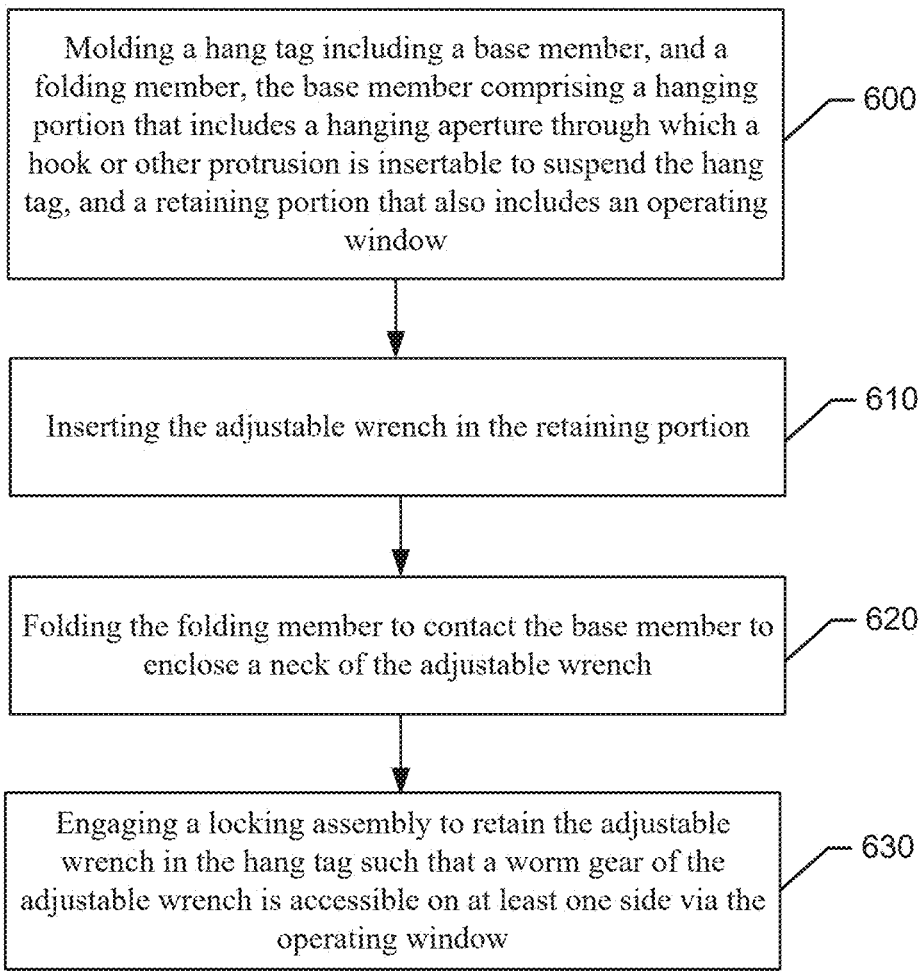
FIG. 11 illustrates a method of packaging an adjustable wrench for display in accordance with an example embodiment.

FIG. 11 illustrates a block diagram of a method of packaging an adjustable wrench for display. The method may include molding a hang tag including a base member, and a folding member, where the base member includes a hanging portion that includes a hanging aperture through which a hook or other protrusion is insertable to suspend the hang tag, and a retaining portion that also includes an operating window at operation 600. The method further includes inserting the adjustable wrench in the retaining portion at operation 610, folding the folding member to contact the base member to enclose a neck of the adjustable wrench at operation 620, and engaging a locking assembly to retain the adjustable wrench in the hang tag such that a worm gear of the adjustable wrench is accessible on at least one side via the operating window at operation 630.

As can be appreciated from the example of FIGS. 1-10, example embodiments may also define a hang tag itself, which may or may not be made via the method of FIG. 11, but which may in any case be useful for display of an adjustable wrench having a fixed jaw and a movable jaw, the movable jaw being operable via turning a worm gear exposed on opposite sides of the adjustable wrench may be provided. The hang tag may include a base member, and a folding member that folds to engage with the base member to retain the adjustable wrench in the hang tag. The base member may include a hanging portion that includes a hanging aperture through which a hook or other protrusion is insertable to suspend the hang tag, and a retaining portion that also includes the folding member and that retains the adjustable wrench responsive to the folding member contacting the base member to enclose a neck of the adjustable wrench via a locking assembly. An operating window may be formed at the retaining portion of the base member to enable access to the worm gear on both of the opposite sides of the adjustable wrench.

The hang tag and/or its components may include a number of modifications, augmentations, or optional additions, some of which are described herein. The modifications, augmentations or optional additions may be added in any desirable combination. For example, the base member may further include a label portion disposed between the hanging portion and the retaining portion, and the label portion may be distinguished from the hanging portion and the retaining portion by having a different finish or thickness, or by having defined border. In an example embodiment, the retaining portion may further include a fixed jaw retainer extending away from the base member to enclose a portion of the fixed jaw on at least three sides, and a neck retainer including portions of each of the folding member and the base member to support the adjustable wrench such that the fixed jaw extends into the fixed jaw retainer and the worm gear is proximate the operating window. In some cases, the base member may further include a movement limiter protruding substantially perpendicularly away from the base member proximate to the fixed jaw retainer to limit movement of a body portion of the adjustable wrench in a direction toward the hanging aperture. In an example embodiment, the neck retainer may include a top wall, a bottom wall formed opposite the top wall, a first sidewall, and second sidewall formed opposite the first sidewall. In such cases, the first and second sidewalls and the bottom wall may extend along respective peripheral edges of the base member responsive to the folding member being folded to contact the base member, the top wall may be formed at an angle relative to the bottom wall, and the top wall and the bottom wall may each have a gap formed therein through which the neck of the adjustable wrench passes to support weight of the adjustable wrench on the top wall responsive to the folding member being folded to contact the base member. In some cases, the locking assembly may include a first locking portion disposed at a bottom corner of the base portion opposite the bridge member, and a second locking portion disposed at a bottom corner of the folding member opposite the bridge member. In an example embodiment, the first locking portion may include a first locking protrusion and a first locking aperture, the second locking portion may include a second locking protrusion and a second locking aperture, and the first locking protrusion may engage the second locking aperture, and the second locking protrusion may engage the first locking aperture to actuate the locking assembly to retain the adjustable wrench responsive to the folding member contacting the base member enclosing the neck of the adjustable wrench. In some cases, a distal end of the first locking protrusion may include a first cantilevered extension facing away from the first locking aperture, and a distal end of the second locking protrusion comprises a second cantilevered extension facing away from the second locking aperture. In an example embodiment, the first cantilevered extension passes through the second locking aperture to engage the second sidewall, and the second cantilevered extension passes through the first locking aperture to engage the base member. In some cases, the first locking protrusion may be spaced apart from the first locking aperture by a same amount as the second locking protrusion is spaced apart from the second locking aperture. In an example embodiment, the base member may include one or more guide walls to interface with one or more of the first and second sidewalls, and the top and bottom walls to ensure alignment of the first locking aperture with the second locking protrusion, and alignment of the first locking protrusion with the second locking aperture responsive to folding of the folding member into contact with the base member. In some cases, the operating window may be disposed proximate to the gap in the top wall of the folding member. In an example embodiment, the hang tag may further include a bridge member connecting the base member and the folding member such that the base member, the folding member and the bridge member are all molded together as a unitary molded product. In some cases, the neck retainer may include a top wall and a bottom wall formed opposite the top wall, and the bridge member may extend from the top wall to the bottom wall. In an example embodiment, a first groove may be formed at a first lateral side of the bridge member extending from the top wall to the bottom wall, and a second groove may be formed at a second lateral side of the bridge member extending from the top wall to the bottom wall, the first and second grooves facilitating folding of the folding member toward the base member. In some cases, the operating window may be elongated along a direction formed at an offset angle relative to a longitudinal axis of the adjustable wrench, the offset angle aligning the direction of elongation of the operating window with a line tangential to the worm gear.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A hang tag for display of an adjustable wrench having a fixed jaw and a movable jaw, the movable jaw being operable via turning a worm gear exposed on opposite sides of the adjustable wrench, the hang tag comprising:

a base member; and a folding member that folds to engage with the base member to retain the adjustable wrench in the hang tag, wherein the base member further comprises:

a hanging portion that includes a hanging aperture through which a hook or other protrusion is insertable to suspend the hang tag, and a retaining portion that also includes the folding member and that retains the adjustable wrench responsive to the folding member contacting the base member to enclose a neck of the adjustable wrench via a locking assembly, and wherein an operating window is formed at the retaining portion of the base member to enable access to the worm gear on both of the opposite sides of the adjustable wrench, wherein the retaining portion further comprises:

a fixed jaw retainer extending away from the base member to enclose a portion of the fixed jaw on at least three sides, a neck retainer including portions of each of the folding member and the base member to support the adjustable wrench such that the fixed jaw extends into the fixed jaw retainer and the worm gear is proximate the operating window, wherein the neck retainer comprises a top wall, a bottom wall formed opposite the top wall, a first sidewall, and second sidewall formed opposite the first sidewall, wherein the first and second sidewalls and the bottom wall extend along respective peripheral edges of the base member responsive to the folding member being folded to contact the base member, wherein the top wall is formed at an angle relative to the bottom wall, and wherein the top wall and the bottom wall each have a gap formed therein through which the neck of the adjustable wrench passes to support weight of the adjustable wrench on the top wall responsive to the folding member being folded to contact the base member.

2. The hang tag of claim 1, wherein the base member further comprises a label portion disposed between the hanging portion and the retaining portion, and wherein the label portion is distinguished from the hanging portion and the retaining portion by having a different finish or thickness, or by having defined border.

3. The hang tag of claim 1, wherein the base member further comprises a movement limiter protruding substantially perpendicularly away from the base member proximate to the fixed jaw retainer to limit movement of a body portion of the adjustable wrench in a direction toward the hanging aperture.

4. The hang tag of claim 1, wherein the locking assembly comprises a first locking portion disposed at a bottom corner of the base portion opposite the bridge member, and a second locking portion disposed at a bottom corner of the folding member opposite the bridge member.

5. The hang tag of claim 4, wherein the first locking portion comprises a first locking protrusion and a first locking aperture, wherein the second locking portion comprises a second locking protrusion and a second locking aperture, and wherein the first locking protrusion engages the second locking aperture, and the second locking protrusion engages the first locking aperture to actuate the locking assembly to retain the adjustable wrench responsive to the folding member contacting the base member enclosing the neck of the adjustable wrench.

6. The hang tag of claim 5, wherein a distal end of the first locking protrusion comprises a first cantilevered extension facing away from the first locking aperture, and wherein a distal end of the second locking protrusion comprises a second cantilevered extension facing away from the second locking aperture.

7. The hang tag of claim 6, wherein the first cantilevered extension passes through the second locking aperture to engage the second sidewall, and wherein the second cantilevered extension passes through the first locking aperture to engage the base member.

8. The hang tag of claim 5, wherein the first locking protrusion is spaced apart from the first locking aperture by a same amount as the second locking protrusion is spaced apart from the second locking aperture.

9. The hang tag of claim 5, wherein the base member includes one or more guide walls to interface with one or more of the first and second sidewalls, and the top and bottom walls to ensure alignment of the first locking aperture with the second locking protrusion, and alignment of the first locking protrusion with the second locking aperture responsive to folding of the folding member into contact with the base member.

10. The hang tag of claim 1, wherein the operating window is disposed proximate to the gap in the top wall of the folding member.

11. The hang tag of claim 1, further comprising a bridge member connecting the base member and the folding member such that the base member, the folding member and the bridge member are all molded together as a unitary molded product.

12. The hang tag of claim 11, wherein the neck retainer comprises a top wall and a bottom wall formed opposite the top wall, and wherein the bridge member extends from the top wall to the bottom wall.

13. The hang tag of claim 12, wherein a first groove is formed at a first lateral side of the bridge member extending from the top wall to the bottom wall, and a second groove is formed at a second lateral side of the bridge member extending from the top wall to the bottom wall, the first and second grooves facilitating folding of the folding member toward the base member.

14. The hang tag of claim 1, wherein the operating window is elongated along a direction formed at an offset angle relative to a longitudinal axis of the adjustable wrench, the offset angle aligning the direction of elongation of the operating window with a line tangential to the worm gear.

15. A method of packaging an adjustable wrench for display, the method comprising:

molding a hang tag including a base member, and a folding member, the base member comprising a hanging portion that includes a hanging aperture through which a hook or other protrusion is insertable to suspend the hang tag, and a retaining portion that also includes an operating window, inserting the adjustable wrench in the retaining portion;

folding the folding member to contact the base member to enclose a neck of the adjustable wrench; and engaging a locking assembly to retain the adjustable wrench in the hang tag such that a worm gear of the adjustable wrench is accessible on at least one side via the operating window, wherein the retaining portion further comprises:

a fixed jaw retainer extending away from the base member to enclose a portion of a fixed jaw of the adjustable wrench on at least three sides, a neck retainer including portions of each of the folding member and the base member to support the adjustable wrench such that the fixed jaw extends into the fixed jaw retainer and the worm gear is proximate the operating window, wherein the neck retainer comprises a top wall, a bottom wall formed opposite the top wall, a first sidewall, and second sidewall formed opposite the first sidewall, wherein the first and second sidewalls and the bottom wall extend along respective peripheral edges of the base member responsive to the folding member being folded to contact the base member, wherein the top wall is formed at an angle relative to the bottom wall, and wherein the top wall and the bottom wall each have a gap formed therein through which the neck of the adjustable wrench passes to support weight of the adjustable wrench on the top wall responsive to the folding member being folded to contact the base member.

16. The method of claim 15, wherein molding the hang tag further comprises molding a bridge member connecting the base member and the folding member with the hang tag such that the base member, the folding member and the bridge member are all molded together as a unitary molded product.

17. The method of claim 15, wherein the operating window is elongated along a direction formed at an offset angle relative to a longitudinal axis of the adjustable wrench, the offset angle aligning the direction of elongation of the operating window with a line tangential to the worm gear.

18. The method of claim 16, wherein the locking assembly comprises a first locking portion disposed at a bottom corner of the base member opposite the bridge member, and a second locking portion disposed at a bottom corner of the folding member opposite the bridge member, wherein the first locking portion comprises a first locking protrusion and a first locking aperture, wherein the second locking portion comprises a second locking protrusion and a second locking aperture, and wherein engaging the locking assembly comprises engaging the first locking protrusion with the second locking aperture, and the second locking protrusion with the second locking aperture responsive to the folding member contacting the base member enclosing the neck of the adjustable wrench.

* * * * *